US008745865B2

(12) United States Patent
Heitz et al.

(10) Patent No.: US 8,745,865 B2
(45) Date of Patent: Jun. 10, 2014

(54) COMPRESSOR SERVICE TOOL

(75) Inventors: Jean-Francois Heitz, Miribel (FR); Jean-Pierre Chanon, Trevoux (FR); Steven E. Von Borstel, Preble, NY (US)

(73) Assignee: Carrier Corporation, Farmington, CT (US)

( * ) Notice: Subject to any disclaimer, the term of this patent is extended or adjusted under 35 U.S.C. 154(b) by 1369 days.

(21) Appl. No.: 12/439,708

(22) PCT Filed: Sep. 6, 2007

(86) PCT No.: PCT/US2007/077719

§ 371 (c)(1), (2), (4) Date: Mar. 3, 2009

(87) PCT Pub. No.: WO2008/030930

PCT Pub. Date: Mar. 13, 2008

(65) Prior Publication Data

US 2010/0180609 A1 Jul. 22, 2010

Related U.S. Application Data

(60) Provisional application No. 60/824,885, filed on Sep. 7, 2006.

(51) Int. Cl.

| | |
|---|---|
| ***B23P 6/00*** | (2006.01) |
| ***B23P 19/00*** | (2006.01) |
| ***B23P 19/04*** | (2006.01) |

(52) U.S. Cl.

USPC ..... 29/888.021; 29/824; 29/822; 29/823; 29/402.03

(58) Field of Classification Search

USPC ..... 29/888.021, 402.01, 402.03, 822, 823, 29/824; 417/234

See application file for complete search history.

(56) References Cited

U.S. PATENT DOCUMENTS

| | | | | | |
|---|---|---|---|---|---|
| 2,497,785 | A | | 2/1950 | Melcher | |
| 2,896,909 | A | * | 7/1959 | Taylor | 254/9 R |
| 2,929,519 | A | * | 3/1960 | Taylor | 414/590 |
| 2,931,519 | A | * | 4/1960 | Beach | 414/589 |
| 3,237,921 | A | * | 3/1966 | Jay | 254/122 |
| 3,771,666 | A | * | 11/1973 | Fournier | 414/591 |
| 3,840,210 | A | * | 10/1974 | Hollingsworth | 254/9 R |
| 4,130,208 | A | * | 12/1978 | Barry | 414/334 |
| 4,157,613 | A | * | 6/1979 | Morrow | 29/732 |
| 4,381,101 | A | * | 4/1983 | Herrin | 254/9 R |
| 4,419,865 | A | | 12/1983 | Szymaszek | |
| 4,440,265 | A | * | 4/1984 | Spagnoli | 182/129 |
| 4,459,732 | A | * | 7/1984 | Driggers | 29/426.3 |
| 4,526,344 | A | * | 7/1985 | Oswald et al. | 254/9 C |
| 4,682,750 | A | * | 7/1987 | Rudolph et al. | 108/145 |
| 4,741,512 | A | * | 5/1988 | Elkuch et al. | 254/9 C |
| 4,895,380 | A | * | 1/1990 | Brooks et al. | 280/32.6 |

(Continued)

FOREIGN PATENT DOCUMENTS

| | | | | | |
|---|---|---|---|---|---|
| FR | 2807412 | A1 | * | 10/2001 | B65G 7/02 |
| JP | 2005220536 | A | * | 8/2005 | E04G 23/06 |

*Primary Examiner* — Essama Omgba

(74) *Attorney, Agent, or Firm* — Carrier Corporation

(57) ABSTRACT

In a method for servicing an apparatus having a compressor (22) mounted to a support structure (32, 38, 40), a guide structure (102, 104; 202, 204) is placed adjacent to the support structure. The compressor is lifted from an installed position. The compressor is withdrawn by rolling the compressor along the support structure and guide structure.

9 Claims, 9 Drawing Sheets

(56) References Cited

U.S. PATENT DOCUMENTS

| | | | | | |
|---|---|---|---|---|---|
| 5,083,892 | A * | 1/1992 | Oswald et al. | 414/458 |
| 5,184,474 | A | 2/1993 | Ferdows | |
| 5,372,353 | A * | 12/1994 | West | 254/10 B |
| 5,445,489 | A * | 8/1995 | Evans et al. | 414/458 |
| 5,449,266 | A * | 9/1995 | Evans | 414/458 |
| 5,460,474 | A * | 10/1995 | Iles | 414/590 |
| 5,569,013 | A * | 10/1996 | Evans et al. | 414/458 |
| 5,595,469 | A * | 1/1997 | Evans | 414/458 |
| 5,722,254 | A | 3/1998 | Roth et al. | |
| 6,112,858 | A * | 9/2000 | Arnst | 187/269 |
| 6,619,620 | B1 * | 9/2003 | Carter | 254/10 C |
| 7,107,677 | B2 * | 9/2006 | Lyons | 29/888.02 |
| 7,200,913 | B2 * | 4/2007 | Laird et al. | 29/468 |
| 7,458,455 | B2 * | 12/2008 | Nakamura et al. | 198/463.3 |
| 7,681,674 | B1 * | 3/2010 | Barnes et al. | 180/8.1 |
| 7,862,285 | B1 | 1/2011 | Dove | |
| 8,051,930 | B1 * | 11/2011 | Barnes et al. | 180/8.3 |
| 2003/0091417 | A1 | 5/2003 | Swann | |
| 2003/0180132 | A1 * | 9/2003 | Morreim | 414/458 |
| 2004/0154111 | A1 * | 8/2004 | Trask | 14/69.5 |
| 2008/0283661 | A1 * | 11/2008 | Henley | 244/114 R |
| 2009/0246039 | A1 * | 10/2009 | Haack et al. | 417/244 |
| 2009/0278098 | A1 * | 11/2009 | Bacon | 254/1 |
| 2011/0002756 | A1 * | 1/2011 | Carr et al. | 414/10 |
| 2011/0064558 | A1 * | 3/2011 | Johnson | 414/800 |
| 2012/0112005 | A1 * | 5/2012 | Chaussee et al. | 244/123.1 |

* cited by examiner

COMPRESSOR SERVICE TOOL

CROSS-REFERENCE TO RELATED APPLICATION

Benefit is claimed of U.S. Patent Application Ser. No. 60/824,885, filed Sep. 7, 2006, and entitled "Compressor Service Tool", the disclosure of which is incorporated by reference in its entirety herein as if set forth at length.

BACKGROUND

The disclosure relates to refrigeration systems. More particularly, the disclosure relates to servicing of compressors of chiller systems.

FIG. 1 shows an exemplary chiller system 20 including a compressor 22. The compressor drives refrigerant along a refrigerant circuit. The refrigerant is used to cool water or another liquid for various purposes including building climate control. The exemplary compressor is housed within a bay 30 of a structure (support structure) 32. The exemplary structure 32 includes longitudinal rails 34 supporting the system atop a ground surface 500 (e.g., a floor or roof surface of the building). Transverse rails 36 are mounted atop the longitudinal rails 34. A pair of longitudinal compressor rails 38 and 40 are mounted atop the rails 36 by vibration isolators 42. A pair of L-brackets or base flanges 44 and 46 form a base of the compressor and are mounted atop the rails 38 and 40, respectively to support the compressor 22. Behind the compressor, an oil separator 50 is also mounted atop the rails 38 and 40. Condenser coil units 60 of the refrigerant circuit are supported above the bay 30 by the structure 32. For purposes of illustration, the exemplary system 20 is shown broken away with other equipment (e.g., evaporators, additional compressors, and the like) not shown.

The compressor 22 must be periodically serviced. Servicing the compressor may require its removal from the bay 30.

SUMMARY

One aspect of the disclosure involves a method for servicing an apparatus having a compressor mounted to a support structure. A guide structure is placed adjacent to the support structure. The compressor is lifted from an installed position. The compressor is withdrawn by rolling the compressor along the support structure and guide structure.

In various implementations, the rolling may include rolling the base of the compressor along at least one plurality of rollers supported by the support structure and the guide structure. Alternatively, the method may include moving a jack in a first direction along the guide structure and at least partially on to the support structure. The raising may comprise raising an end effector of the jack to lift the compressor. The withdrawing may comprise retracting the jack opposite the first direction.

Other aspects of the disclosure involve the apparatus (e.g., a conveyor or means for moving such a compressor or a system including the conveyor/means in combination with aspects of the compressor, support structure, or other components). For example, a chiller apparatus may include such a support structure, compressor, and conveyor/means.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
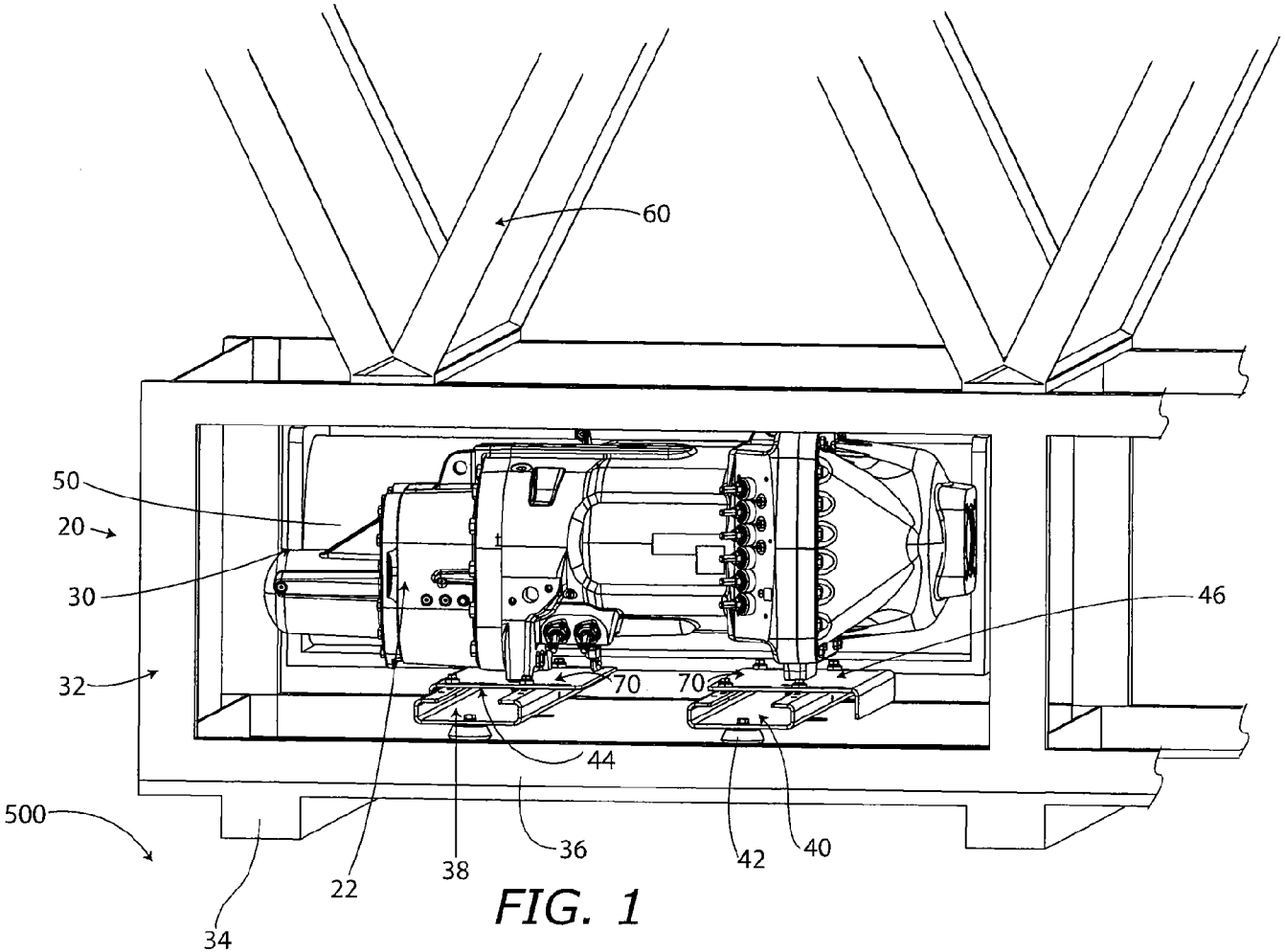
FIG. 1 Prior Art
FIG. 1 is a partial view of a chiller system.
Figure 2:
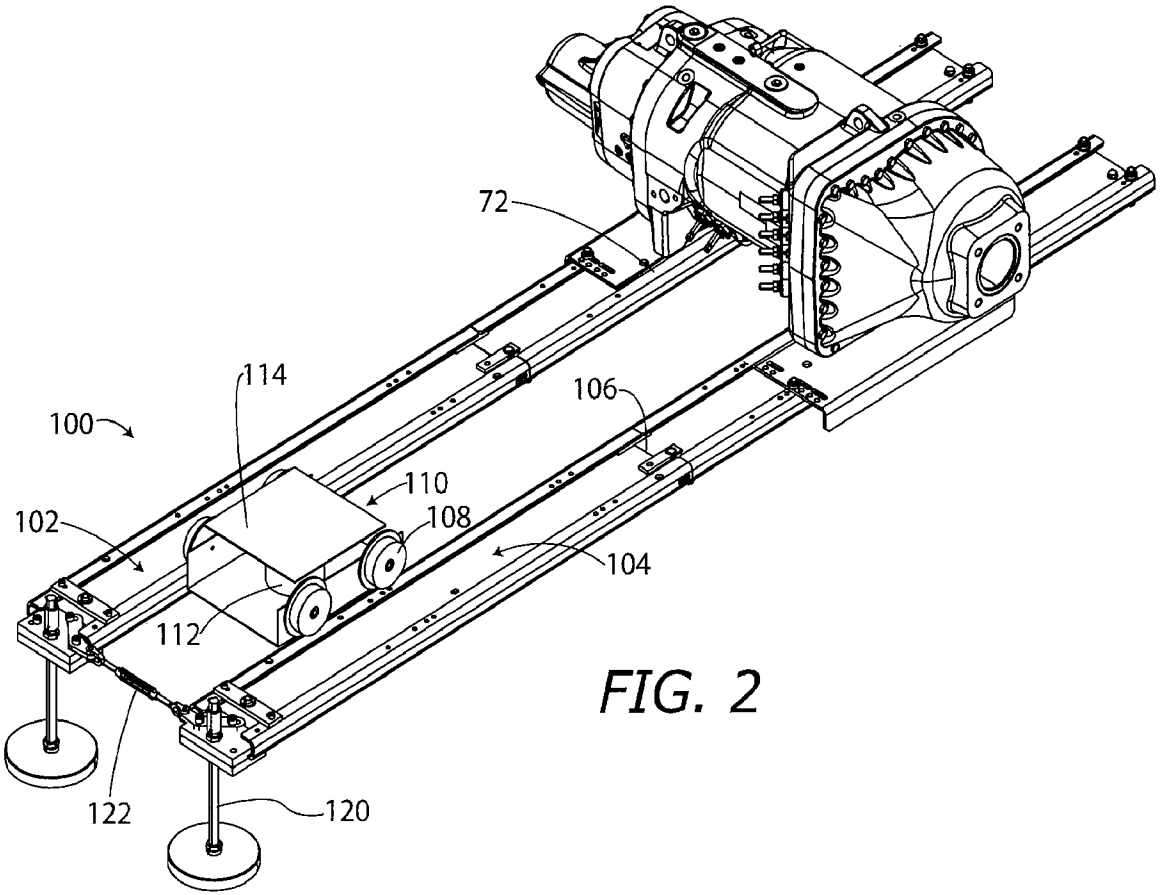
FIG. 2 is a partial view of a first service tool in an extracted condition.

In one implementation, inboard portions 70 (FIG. 1) of the brackets 44 and 46 may be removed to expose inboard portions 72 (FIG. 2) of the tops of the rails 38 and 40. For example, the portions 70 may be cut away in a retrofit of a compressor or eliminated relative to a baseline in original manufacture of the compressor. A service tool 100 (FIG. 2) may then be assembled to the chiller system. The exemplary tool 100 includes a pair of rails 102 and 104. Each rail 102 and 104 has a first end 106 configured to mate with the associated outboard end of the associated one of the rails 38 and 40 to provide a pair of continuous tracks or guide members. The rails may accommodate/engage/support/guide respective left and right pairs of flanged wheels 108 of a trolley unit 110. The trolley unit includes a hydraulic jack 112 having an upwardly-facing end effector 114. The opposite ends of the rails each receive leveling means. Exemplary leveling means are jacks. Exemplary jacks are endless jack screws 120.

The exemplary rails 102 and 104 are mounted to each other by adjustable crossmembers 122 to permit appropriate alignment with the chiller rails. The rails 102 and 104 may be installed to the chiller as a unit. Thereafter, the trolley may be placed on the rails 102 and 104 in a relatively outboard position and with the jack 112 relatively lowered. The trolley may then be translated forward by rolling along the rails. In a relatively inserted position, at least the front two wheels are along the inboard portions 72 of the associated chiller rails. The jack may then be raised so that the end effector 114 engages the underside of the compressor to lift the compressor. Thereafter, the trolley and compressor may be extracted as a unit to permit servicing. The exemplary extraction is from a first condition/position wherein the compressor is within a footprint of the support structure (e.g., at least half of a footprint of the compressor within a footprint of the support structure, more typically entirely) to a second condition/position mostly clear of the support structure (the compressor footprint at least half outside the support structure footprint, more typically entirely outside the footprint).

Figure 3:
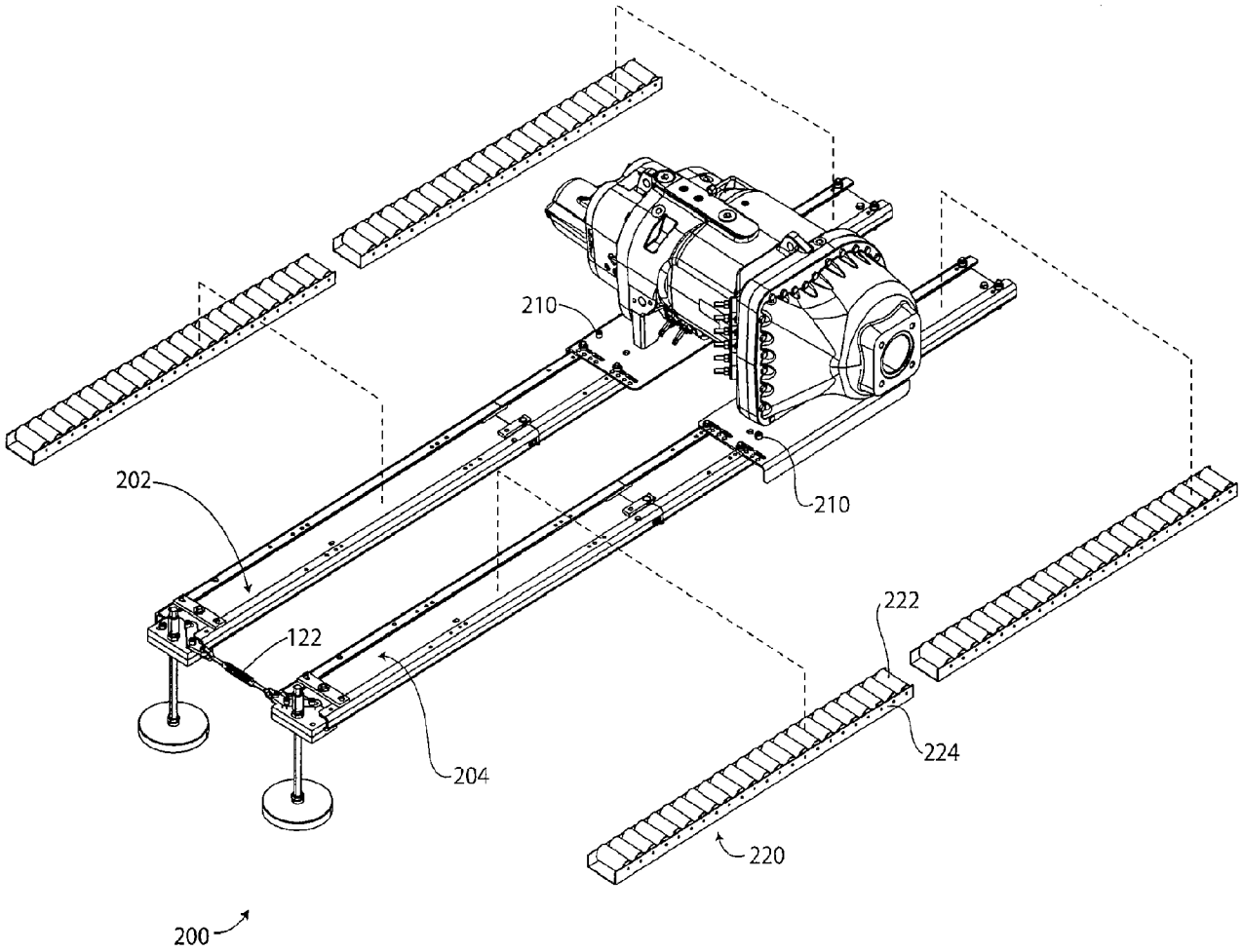
FIG. 3 is a partial, partially exploded, view of a second service tool with the compressor in an inserted/installed condition.

FIG. 3 shows an alternate system 200 wherein rails/tracks/guide members 202 and 204 are formed similarly to the rails 38 and 40 as centrally upwardly-open, C-sectioned, flat-flanged channels. The brackets 44 and 46 may be left intact. When installed, the inboard ends of the tracks 202 and 204 align/mate with the outboard ends of the rails 38 and 40 to form continuous tracks. With the tracks installed, the compressor may be raised slightly. For example, it may be raised by jack screws 210 mounted to the brackets 44 and 46. The jack screws 210 may be added and may engage the rails 38 and 40 or the floor.

Figure 4:
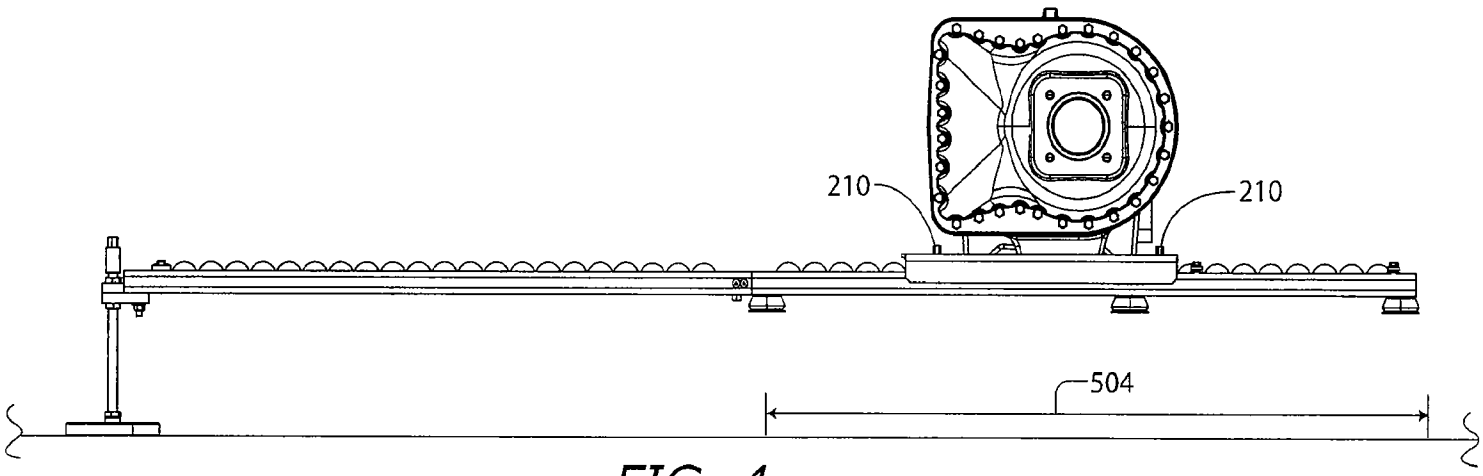
FIG. 4 is a partial side view of the tool of FIG. 3.
Figure 5:
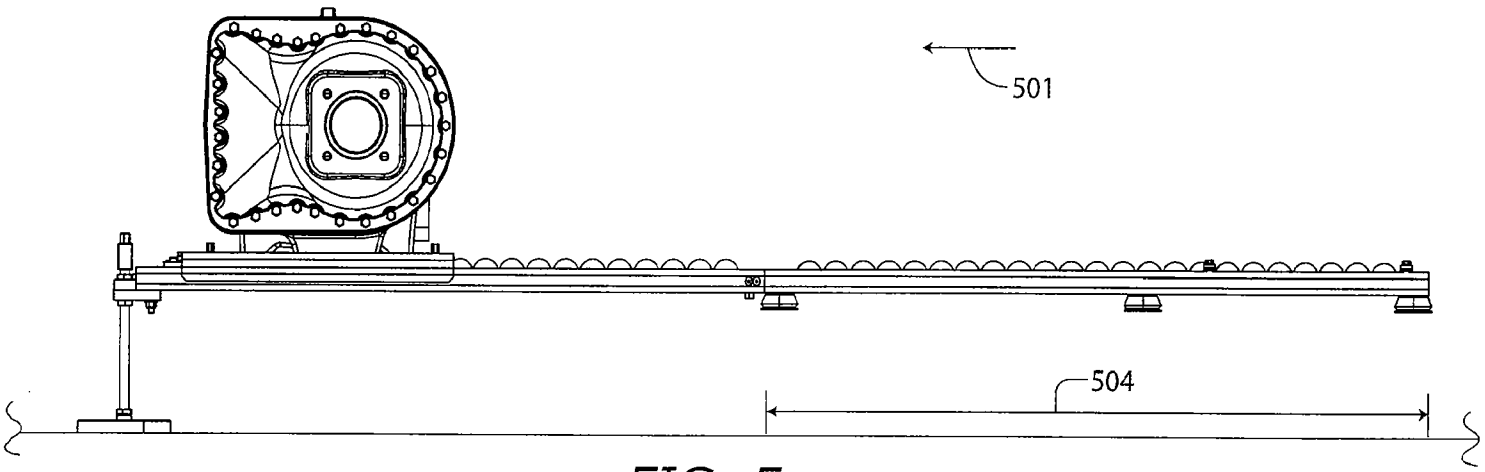
FIG. 5 is a partial side view of the tool of FIG. 3 with the compressor in an extracted condition.

Roller arrays 220 (e.g., a group of rollers 222 mounted between side plates 224 (e.g., of a channel)) may be used to extract and reinsert the compressor. In one example, the arrays 220 are inserted along the rails 38, 40, 202, 204 extending from under the compressor to adjacent outboard ends of the rails 202, 204 (rather, the side plates do not support the rollers for free rotation). The rollers of such arrays do not contact the rails. The compressor may be lowered (e.g., via the jack screws) onto the rollers (FIG. 4) and rolled out/extracted in a direction 502 to a location remote of the support structure footprint 504 (FIG. 5), with the rollers only rotating and their arrays not translated. The installation may be via a reverse of this process.

In other implementations, the roller arrays may move (e.g., if the rollers engage both the compressor and the trails, the arrays will move half the compressor translation distance of the rail; if the rollers engage only the compressor, the arrays will move with the compressor (e.g., as a carriage)). The arrays may be sized to permit this.

In yet other implementations, partial roller arrays are pre-installed along the rails 38 and 40.

In yet other implementations, a winch may replace or supplement the use of a jack on a trolley or a jack used with rollers.

Figure 6:
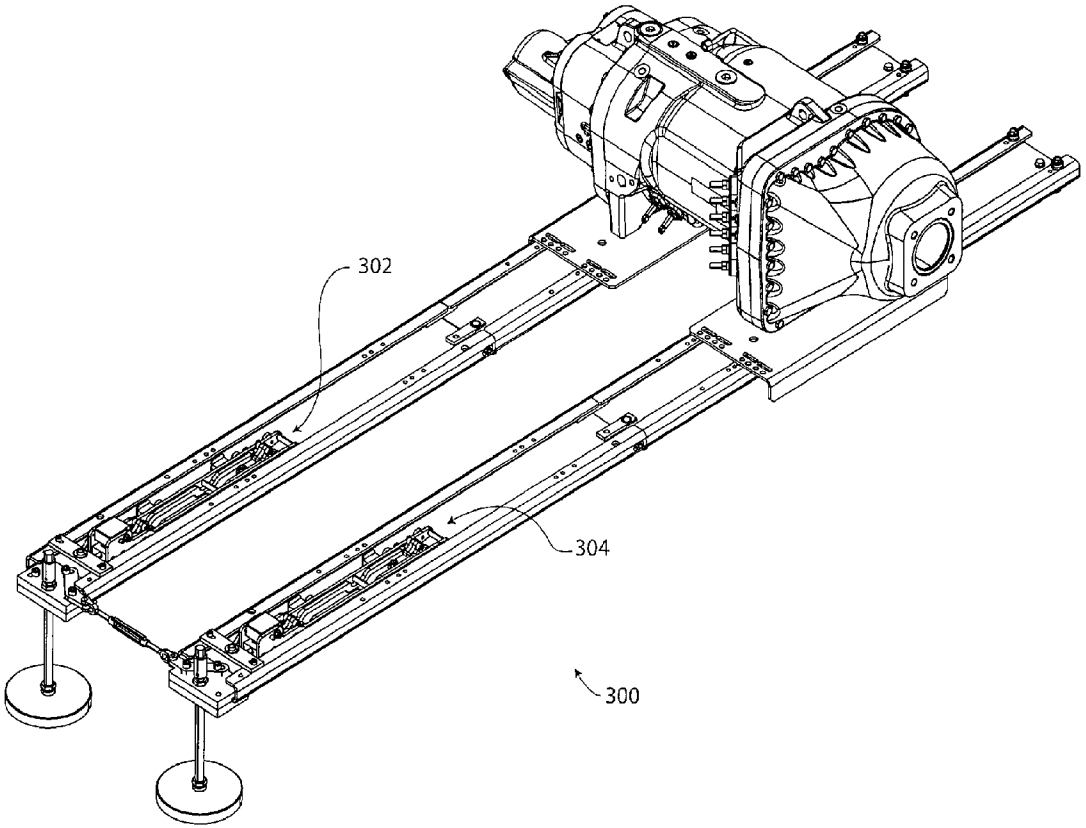
FIG. 6 is a partial view of a third service tool with the compressor in an inserted/installed condition.

FIG. 6 shows an alternate system 300 wherein components in common with this system 200 are referenced with like numerals. The system 300 uses a pair of moving (rolling) roller units formed as carriages 302 in place of the roller arrays 220. The carriages 302 may initially be positioned respectively in the tracks 202 and 204 and shifted (e.g., rolled) thereon to positions below the compressor brackets 44 and 46, respectively. As is discussed further below, the carriages may have a feature for jacking up the compressor to permit the compressor to be rolled along the tracks via the carriages. Thus, the brackets 44 and 46 may lack the jack screws 210.

Figure 7:
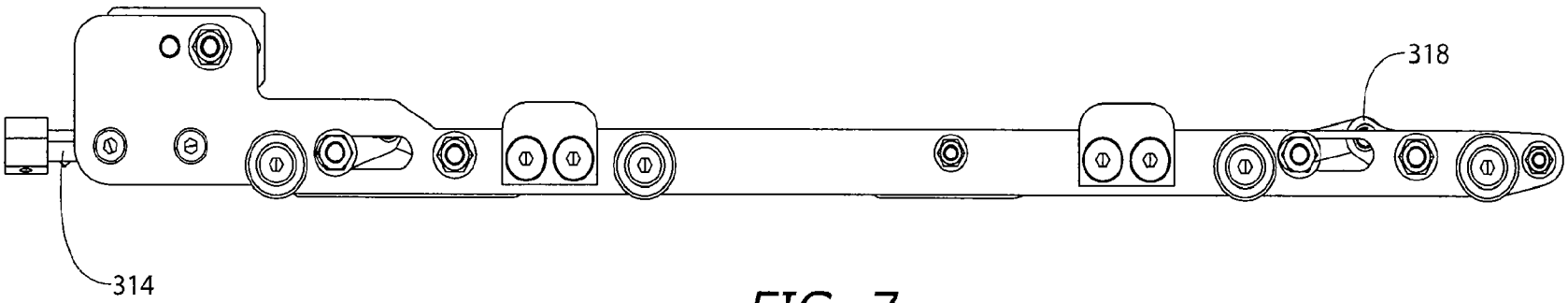
FIG. 7 is a side view of a carriage of the tool of FIG. 6 in a lowered condition.
Figure 8:
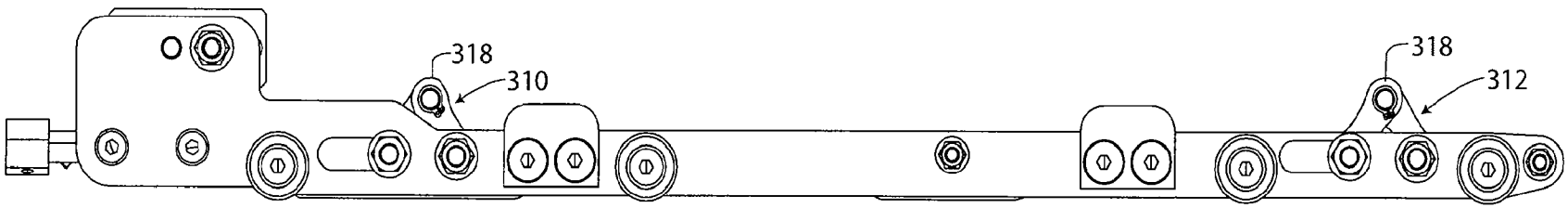
FIG. 8 is a side view of the carriage of FIG. 7 in a raised condition.
Figure 9:
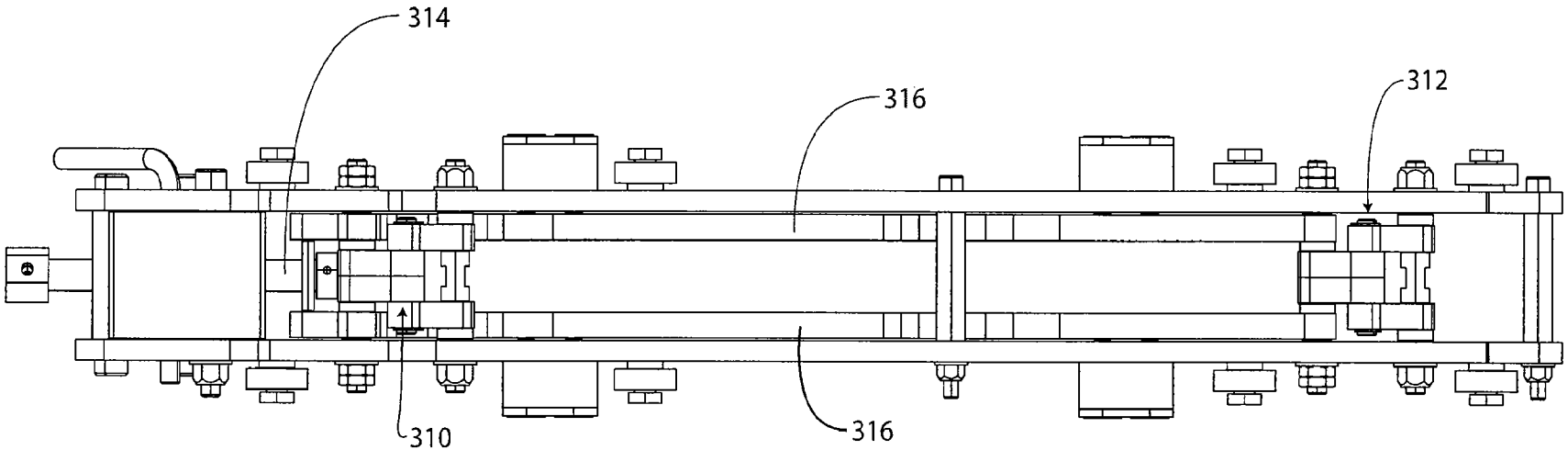
FIG. 9 is a top view of the carriage of FIG. 7.
Figure 10:
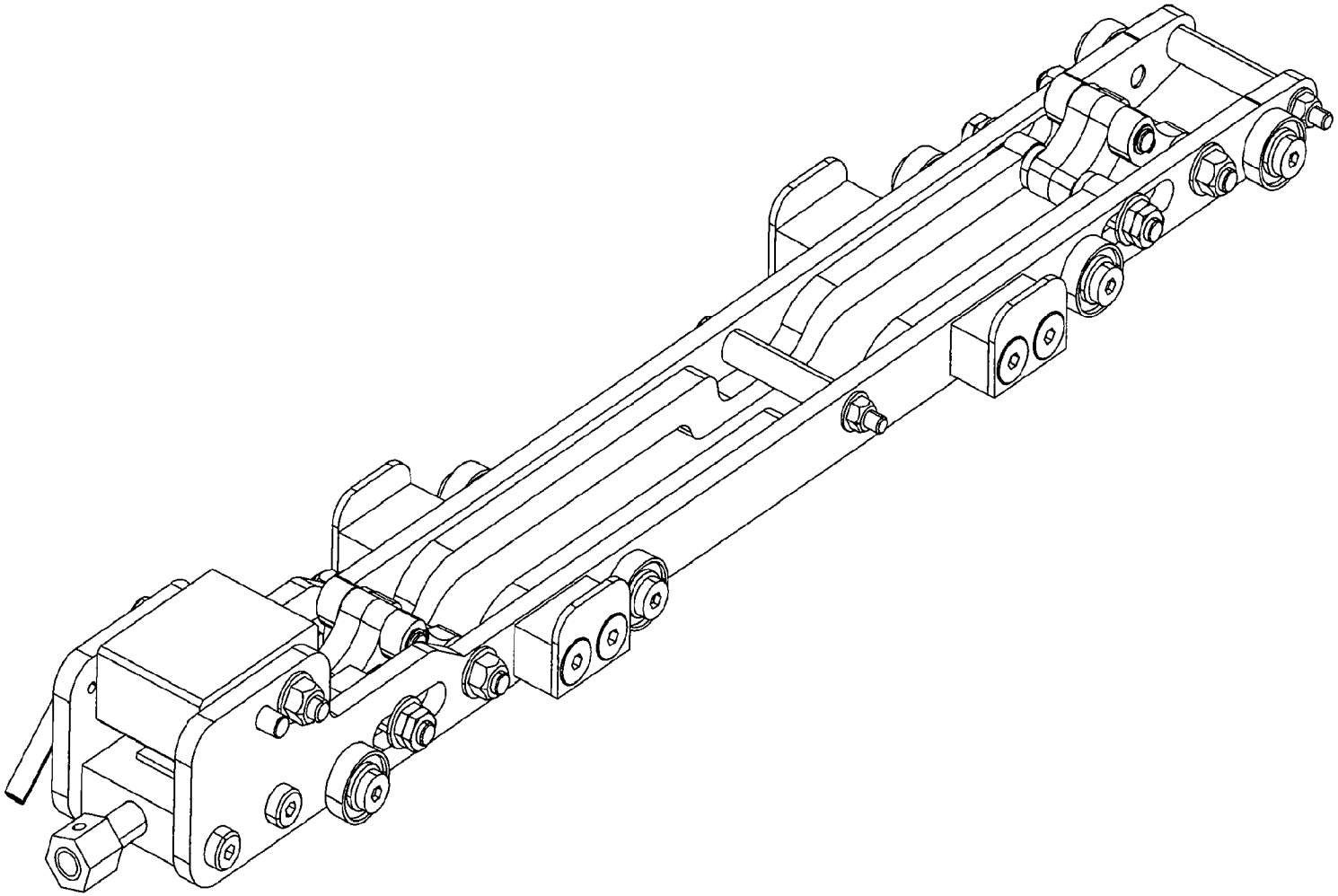
FIG. 10 is a perspective view of the carriage of FIG. 7.
Figure 11:
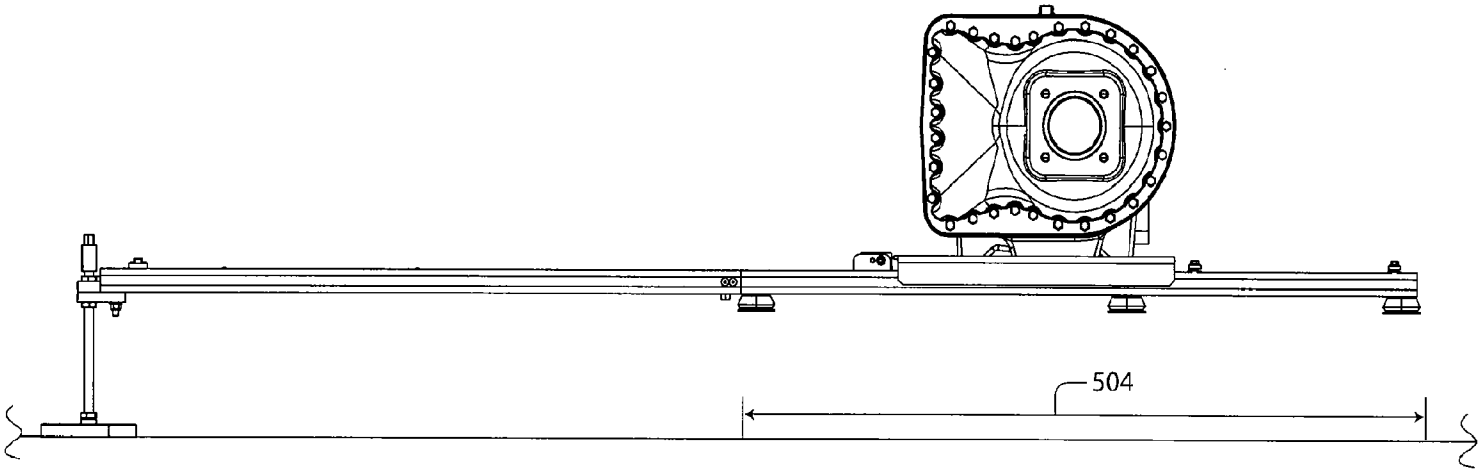
FIG. 11 is a partial side view of the tool of FIG. 6.

FIG. 7 shows an exemplary carriage 302. The carriage has a frame 304 and a plurality of rollers (e.g., wheels) 306 for rolling the carriage along the associated rails (e.g., along the rail web). For jacking the compressor, a jack mechanism 308 includes first and second partial scissor jack elements 310 and 312 (shown raised in FIG. 8) commonly driven by a jack screw 314 (e.g., which is rotated by a user such as by using a wrench). FIG. 7 shows a partially raised position in solid line and a lowered position in broken line. The exemplary jack screw 314 acts directly upon the first element 310 and indirectly upon the second element via connecting bars 316 (FIG. 9). Hinge portions 318 of the jack elements 310 and 312 serve as a jack end effectors for engaging the undersides of the brackets 44 and 46 to lift the compressor. Each of the jack elements 310 and 312 includes a fixed link and a moving link joined at the hinge portion 318. The fixed link has a fixed pivot stationary relative to the carriage frame; whereas the moving link has a moving pivot which is driven between first and second positions shown in FIGS. 7 and 8 to raise the end effectors. After an exemplary unbolting of the brackets 44 and 46 from the rails 38 and 40, the carriages 302 may be (in their lowered condition) rolled along the rails to an inserted position below the compressor. Thereafter, the carriages may be jacked to a raised condition to jack up the compressor. FIG. 11 shows the carriages inserted below the compressor and jacking up the compressor. Once jacked up, the compressor and carriages may be rolled out as a unit to the extracted position.

Figure 12:
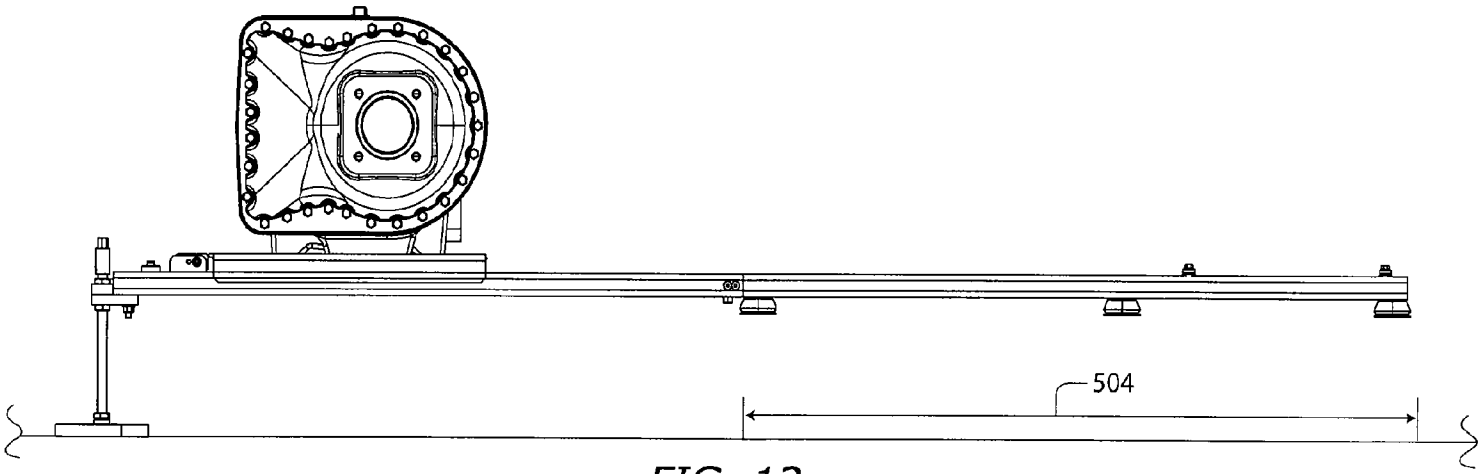
FIG. 12 is a partial side view of the tool of FIG. 6 with the compressor in an extracted condition.

FIG. 12 shows the compressor in the extracted position. As with the other embodiments, insertion/reinstallation may be via a reversal of the extraction/removal process.

One or more embodiments have been described. Nevertheless, it will be understood that various modifications may be made. For example, details of the particular compressors involved may influence details of the associated tools. Accordingly, other embodiments are within the scope of the following claims.

What is claimed is:

1. A method for servicing an apparatus, the apparatus having a compressor mounted to a support structure, the method comprising:

placing a guide structure comprising a first guide rail and a second guide rail adjacent the support structure;

inserting a pair of roller units on the support structure beneath the compressor, wherein:

the pair of roller units comprises a first roller unit for engaging the first guide rail and a second roller unit for engaging the second guide rail;

the first roller unit has:

a frame:

a plurality of rollers for engaging the first guide rail; and a jack mechanism for lifting the compressor; and the second roller unit has:

a frame:

a plurality of rollers for engaging the second guide rail; and a jack mechanism for lifting the compressor;

lifting the compressor from an installed position; and withdrawing the lifted compressor by rolling the compressor along the support structure and the guide structure.

2. The method of claim wherein each jack mechanism comprises:

a first partial scissor jack element;

a second partial scissor jack element;

connecting bars; and a jack screw acting directly upon the first element and acting upon the second element via the connecting bars.

3. The method of claim 1 wherein:

the installed position is below a condenser coil.

4. The method of claim 1 wherein:

the apparatus is a chiller; and the compressor is a screw compressor.

5. The method of claim 1 wherein:

the guide structure is placed adjacent the support structure while the compressor is already in the installed position.

6. The method of claim 5 further comprising:

reinserting the compressor by rolling the compressor along the guide structure and the support structure;

lowering the compressor to the installed position; and after the lowering, removing the guide structure.

7. A compressor service tool comprising:

a first guide rail;

a second guide rail;

leveling means for leveling the first guide rail and second guide rail when first ends of the guide rails are coupled to a support structure; and at least one roller unit engageable to the first guide rail and second guide rail to roll along the first and second guide rails for guiding a compressor from a first position within a footprint of the support structure to a second position in which the compressor is mostly clear of the footprint, wherein:

the at least one roller unit comprises a pair of roller units, the pair of roller units being a first roller unit for engaging the first guide rail and a second roller unit for engaging the second guide rail;

the first roller unit has:

a frame;

a plurality of rollers for engaging the first guide rail; and a jack mechanism for lifting the compressor; and the second roller unit has:

a frame;

a plurality of rollers for engaging the second guide rail; and a jack mechanism for lifting the compressor.

8. The compressor service tool of claim 7 wherein:

each of the roller units comprises:

a carriage frame; and a plurality of wheels as the associated rollers.

9. The compressor service tool of claim 7 wherein each jack mechanism comprises:

a first partial scissor jack element;

a second partial scissor jack element;

connecting bars; and a jack screw acting directly upon the first element and acting upon the second element via the connecting bars.

* * * * *